United States Patent [19]

Dempou et al.

[11] Patent Number: 4,569,205

[45] Date of Patent: Feb. 11, 1986

[54] ELECTRIC REFRIGERATOR HAVING IMPROVED FREEZING AND DEFROSTING CHARACTERISTICS

[75] Inventors: Kazuo Dempou; Hideo Niida; Kunio Yokoyama, all of Oosaka, Japan

[73] Assignee: Kabushiki Kaisha Toshiba, Kawasaki, Japan

[21] Appl. No.: 633,887

[22] Filed: Jul. 24, 1984

[30] Foreign Application Priority Data

Jul. 25, 1983 [JP] Japan ..... 58-136475

[51] Int. Cl.[4] ..... F25D 21/06

[52] U.S. Cl. ..... 62/155; 62/199

[58] Field of Search ..... 62/155, 156, 197, 198, 62/199, 200, 521, 522

[56] References Cited

U.S. PATENT DOCUMENTS 4,227,379 10/1980 Oonishi ..... 62/199 X
4,270,364 6/1981 Oonishi et al. ..... 62/198
4,327,556 5/1982 Zampini et al. ..... 62/155 X

FOREIGN PATENT DOCUMENTS 0096963 8/1975 Japan .
0148963 11/1975 Japan .
0131244 11/1977 Japan .

*Primary Examiner*—Harry Tanner
*Attorney, Agent, or Firm*—Cushman, Darby and Cushman

[57] ABSTRACT

An electric refrigerator is designed to comprise a freezing chamber provided with a gas duct for drawing off a cooling gas from the freezing chamber and refluxing the cooling gas thereto. A main freezing evaporator is provided in the gas duct to freeze foodstuff stored in the freezing chamber by circulating a cooling gas through the freezing chamber and gas duct. The refrigerator also comprises an auxiliary shelf-shaped freezing evaporator for directly freezing the foodstuff placed thereon in all directions. A damper unit involved in the refrigerator mechanically operates a gas circulation valve provided in the gas duct. During the defrosting mode, the freezing evaporators are rendered inoperative, and the main freezing evaporator is heated to remove frost deposited thereon. During this interval, the damper unit causes the gas circulation valve to close the gas duct. As a result, steam produced by the frost melting from the main freezing cooler is prevented from entering the freezing chamber through the gas duct and being frozen on the surface of the main freezing evaporator.

16 Claims, 7 Drawing Figures

ELECTRIC REFRIGERATOR HAVING IMPROVED FREEZING AND DEFROSTING CHARACTERISTICS

BACKGROUND OF THE INVENTION

The present invention relates in general to an electric refrigerator and, more particularly, to an electric refrigerator which comprises both independent freezing and refrigerating chambers, and is so characteristically designed as to defrost the cooler of the freezing chamber as the need arises.

As the contribution of home freezing to the improvement in the life span of foodstuff is more appreciated, greater importance is attached to an electric refrigerator which has indendent freezing and refrigerating chambers. As greater demand is made to increase the capacity of a refrigerator to store frozen foodstuff, the freezing chamber tends to be enlarged. A cooler for an enlarged freezing chamber is increased in cooling capacity to carry out efficient freezing.

The generally known method of cooling a freezing chamber contains a process of directly cooling a freezing chamber and a process of cooling a freezing chamber by circulating cold-air streams. A direct-cooling type freezing chamber has a cooling plate, covering the inner wall of the freezing chamber, to freeze foodstuff by directly ejecting cold-air streams on the foodstuff. The latter indirect-cooling type freezer chamber involves a fan for which effects the circulation of cold-air streams delivered from the cooler through a freezing chamber, thereby to freeze foodstuff stored therein. The above-mentioned foodstuff-freezing processes are accompanied with the drawbacks that, as the operation time of a refrigerator is extended, frost tends to settle more prominently on the outer wall of the cooler, resulting in a decline in its operating efficiency. In view of this drawback, the conventional refrigerator is provided with a defrosting heater built in the freezing chamber. Therefore, difficulties have been encountered in effectively eliminating or restricting the harmful effect exerted by the defrosting heater on stored foodstuff.

SUMMARY OF THE INVENTION

It is accordingly the object of the present invention to provide a new and improved electric refrigerator with an independent freezing chamber, wherein foodstuff stored in the freezing chamber can be uniformly frozen with a good effect and, moreover, a cooler for the freezing chamber can be efficiently defrosted while minimizing the adverse thermal effect of a defrosting heater on the stored frozen foodstuff.

With the electric refrigerator according to this invention, a freezing chamber and refrigerating chamber enclosed in a housing are thermally insulated from the atmosphere. The freezing chamber comprises an air duct for accelerating the withdrawal of air from the freezing chamber and the reflux of the gas thereinto. A first freezing cooler built in the air duct of the freezing chamber circulates cold air streams through the freezing chamber and air duct to freeze the object of freezing. A second freezing cooler so built in the freezing chamber as to allow, for example, foodstuff to be placed on the cooler directly, freezes the object of freezing. A damper unit mechanically operates an air flow valve provided in the air duct, thereby controlling the flow of cold air streams through the duct. During the defrosting operation, the first and second freezing coolers are rendered inoperative. The first freezing cooler is heated to dissolve frost deposited on its surface. During this period, the damper unit causes the air flow valve to be closed, thereby preventing the steam produced by the defrosting in the first freezing cooler from entering the freezing chamber through the air duct and, consequently, being frozen on the surface of the first freezing cooler.

BRIEF DESCRIPTION OF THE DRAWINGS

The present invention is best understood by reference to the accompanying drawings in which.

DETAILED DESCRIPTION OF THE PREFERRED EMBODIMENTS

Figure 1:
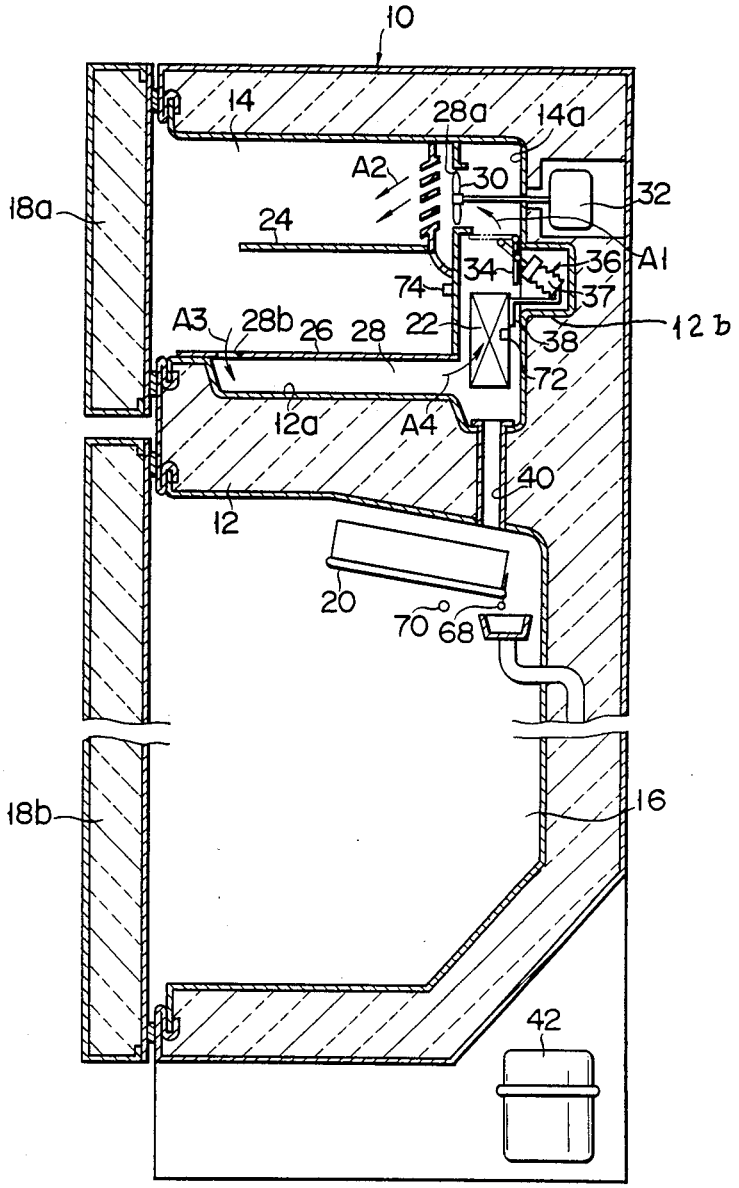
FIG. 1 is a cross sectional view of an electric refrigerating apparatus according to one preferred embodiment of this invention.

Referring now to FIG. 1, there is illustrated an electric refrigerator with independent refrigerating and freezing chambers in accordance with one embodiment of this invention. An adiabatic cabinet 10 has a partition wall 12 dividing the interior of the cabinet 10 into a freezing chamber 14 and cold chamber (or refrigerating chamber) 16. Thermally insulating door 18*a*, 18*b* are respectively hinged at the front openings of the freezing and refrigerating chamber 14, 16. An exclusive cooler 20 is fitted by the known process to the upper portion of the refrigerating chamber 16. Provided in the freezing chamber 14 are two different coolers 22, 24.

A depression or groove 12*a* is formed in the upper surface of the partition wall 12. An additional groove 12*b* is formed in a side surface of the partition wall 12. A metal plate 26 is provided in the freezing chamber 14 so as to cover the wall groove 12*a* and define a prescribed space with an inner surface 14*a* of the freezing chamber. As a result, an air duct 28 is formed which allows for the circulation of air streams through the freezing chamber 14. A first cooler constituted by an evaporator 22, acting as an indirect cooling unit, is fixed to the wall 14*a* of the freezing chamber 14 so as to be positioned in the air duct 28. A second cooler constituted by an evaporator 24, acting as a direct cooling unit, is fixed to the vertical portion of the metal plate 26 in the form of a shelf. Therefore, the object of freezing, for example, foodstuff, can be placed on the shelf-shaped evaporator 24 to be directly frozen thereby. A fan 30 driven by a motor 32 is provided in the air duct 28. The fan 30 draws off cold-air streams delivered from the first evaporator 22 at the outlet 28*a* of the air duct 28 and circulates the cold air stream back to the duct 28 through the freezing chamber 14, holding the object of freezing (foodstuff), and the section port 28*b* of the air duct 28.

A plate valve 34 is provided in the air duct 28 within grove 12*b*. A damper unit 36 is connected to the evaporator 22 by means of a heat-sensitive tube 38. When the heat-sensitive tube 38 is heated, the bellows 37 of the damper unit 36 swell due to the expansion of the Freon gas held in the heat-sensitive tube 38 and press against the plate valve 34, thereby to close the air duct 28. The partition wall 12 is provided with a penetrating hole 40. This hole 40 ensures the partial connection between the air duct 28 and that upper space of the refrigerating chamber 16 where the evaporator 20 is placed.

Figure 2:
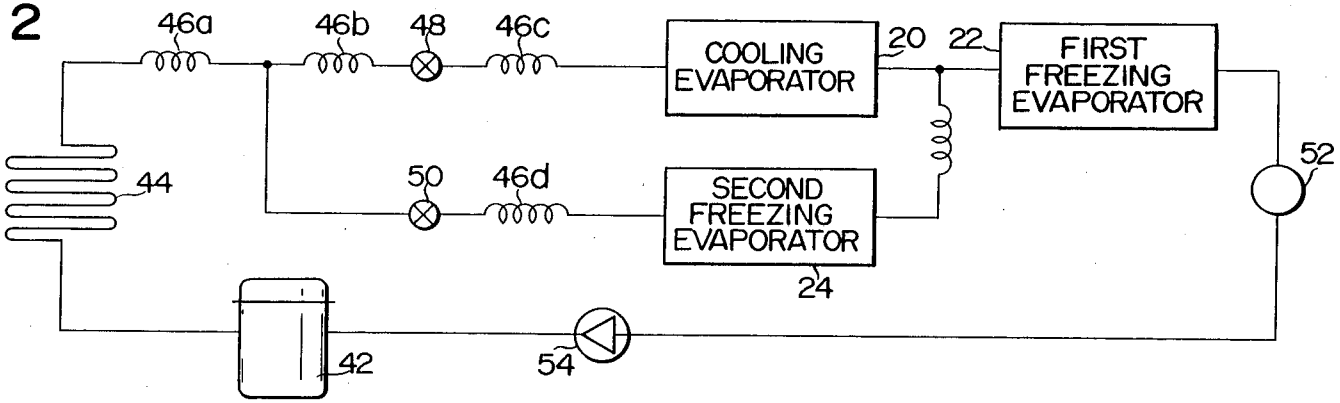
FIG. 2 shows a coolant circulation circuit of the refrigerator of FIG. 1.

FIG. 2 shows the coolant circulation circuit of the refrigerator. A known compressor 42, set at the rear end on the bottom of the refrigerator of FIG. 1, is coupled at one end to the first freezing evaporator 22 through a condensor 44, capillary tubes 46*a*, 46*b*, 46*c*, electromagnetic valve 48, and evaporator 20, which are all provided in the refrigerating chamber 16. The compressor 42 is also connected at the one end to the first freezing evaporator 22 through the condensor 44, capillary tube 46*a*, and then electromagnetic valve 50, capillary tube 46*d*, and second freezing evaporator 24. A refrigerant sent forth from the freezing evaporator 22 is brought back to the compressor 42 through an accumulator 52 and stop valve 54. In the coolant circulation circuit, the electromagnetic valves 48, 50 are suitably controlled such that the flow of the coolant ejected from the compressor 42 is selectively changed between a first flow path in which the coolant runs through the refrigeration-chamber evaporator 20 and first freezing-chamber evaporator 22 and a second flow path in which the coolant flows through both freezing chamber evaporators 22, 24.

Figure 3:
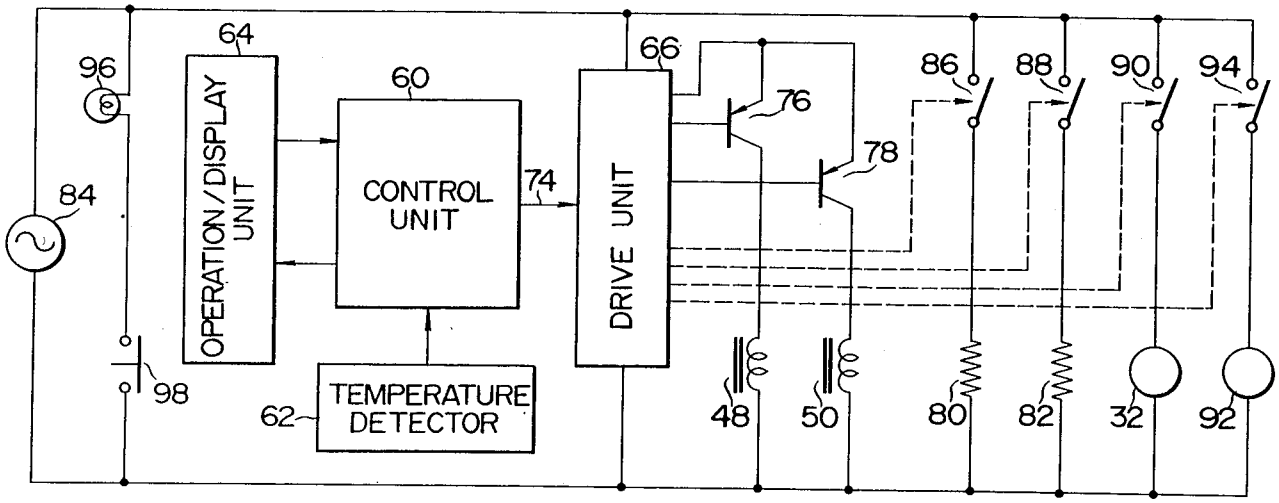
FIG. 3 schematically indicates an overall electrical circuit of the refrigerator of FIG. 1.
Figure 4A:
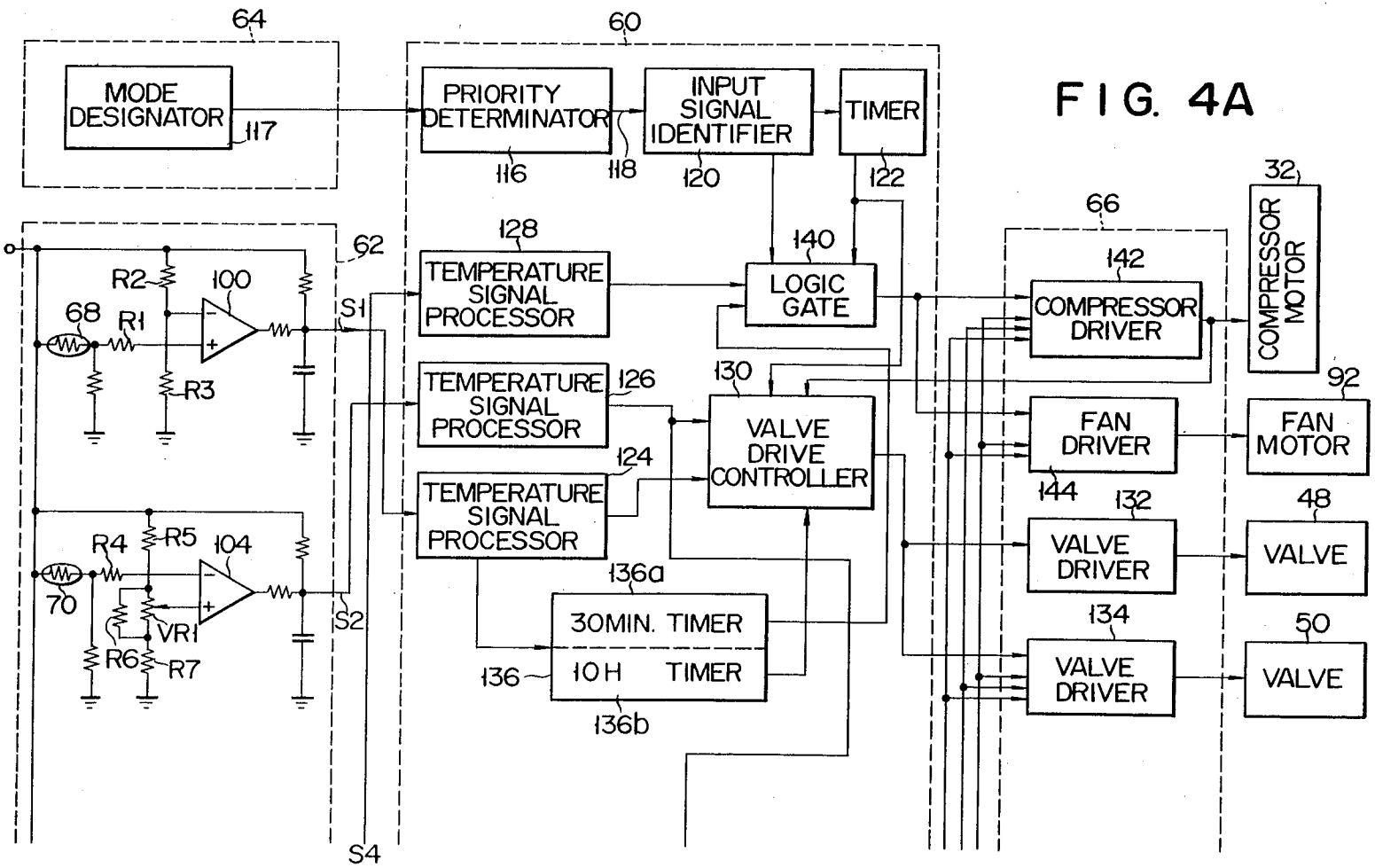
FIGS. 4A and 4B show in greate detail the circuit arrangements of the control unit, drive unit, and temperature detector involved in the refrigerator of FIG. 3.
Figure 4B:
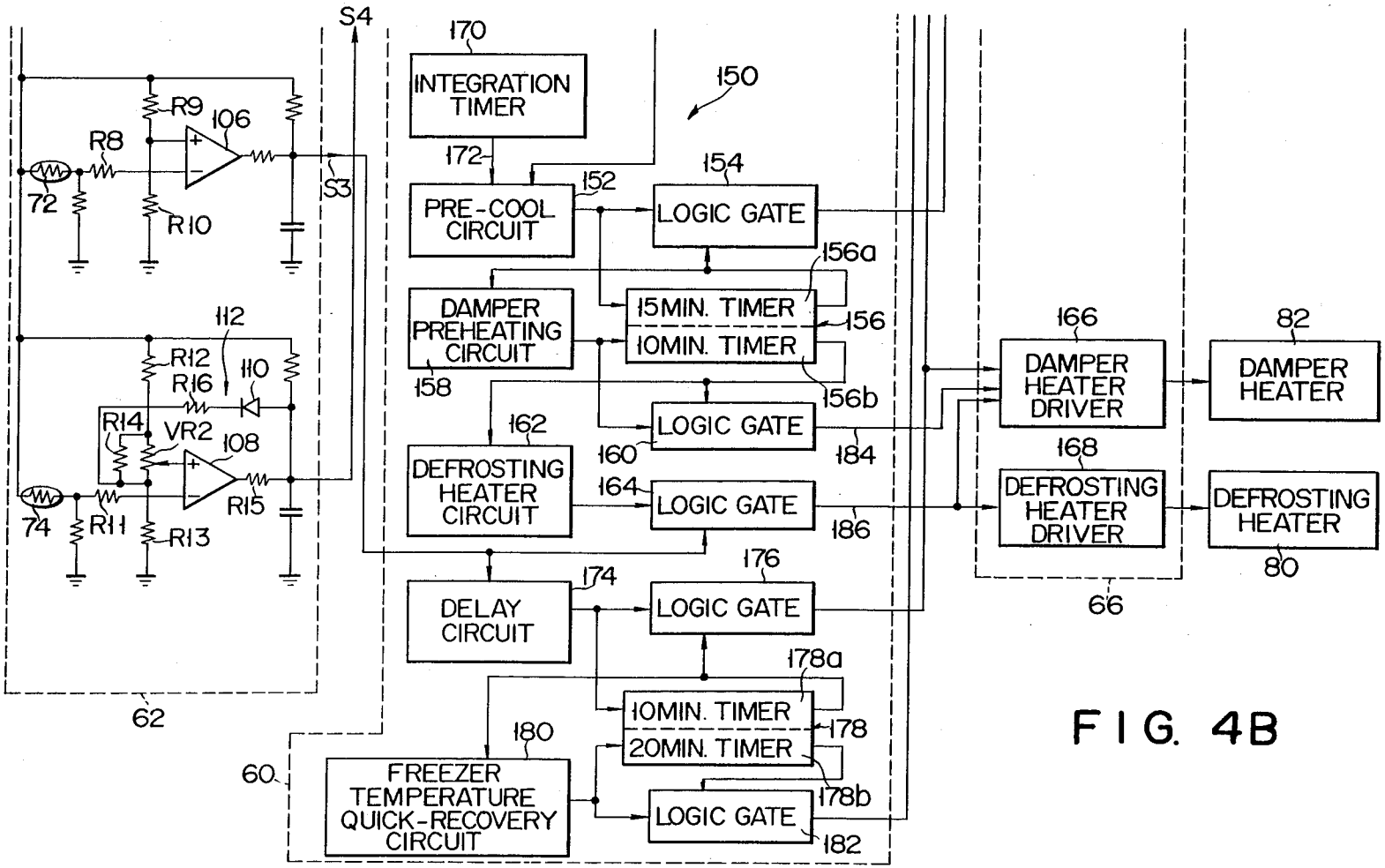
Figure 5A:
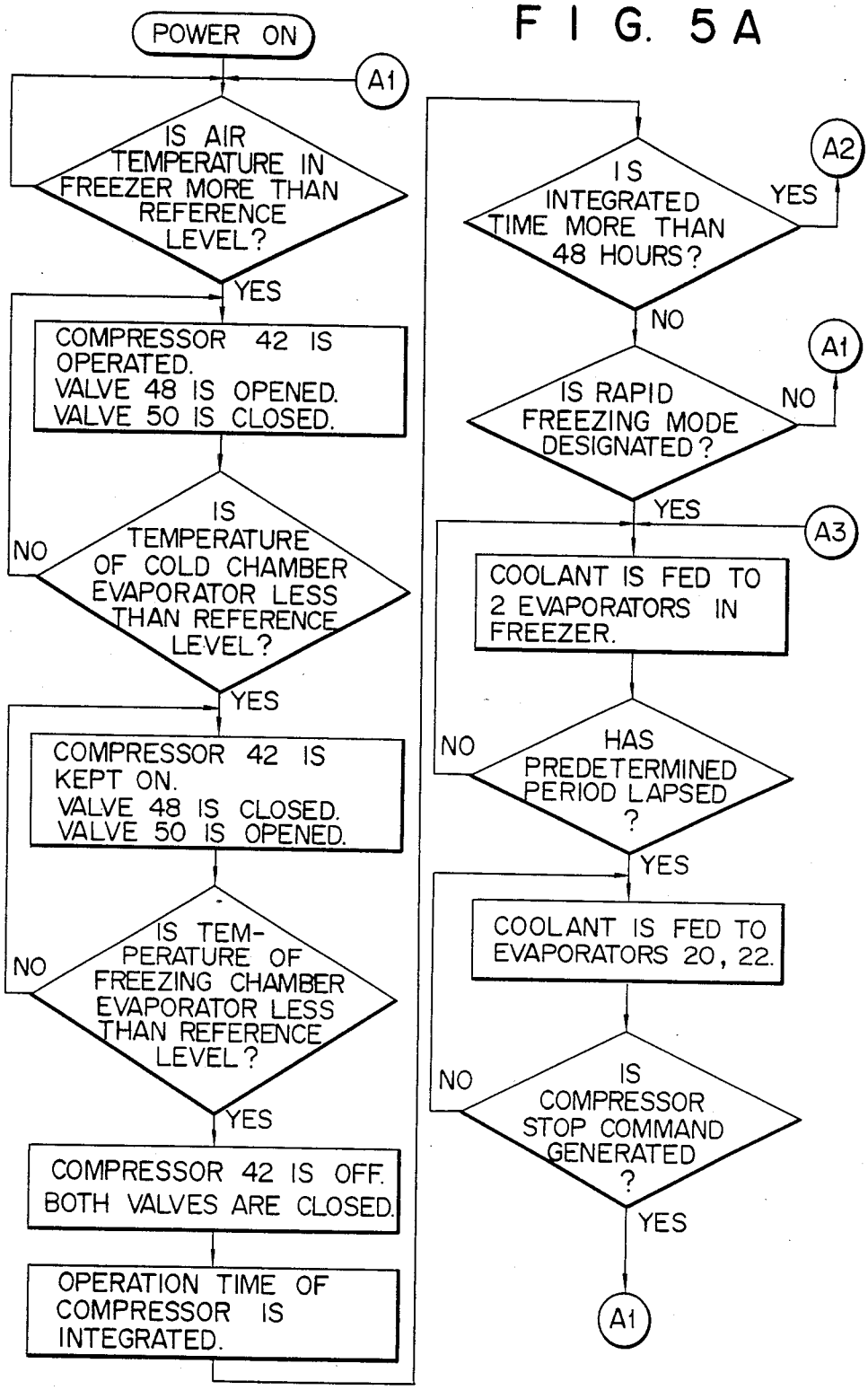
FIG. 5A is a flow chart showing the main steps of the ordinary and rapid refrigeration operations of the subject refrigerator.
Figure 5B:
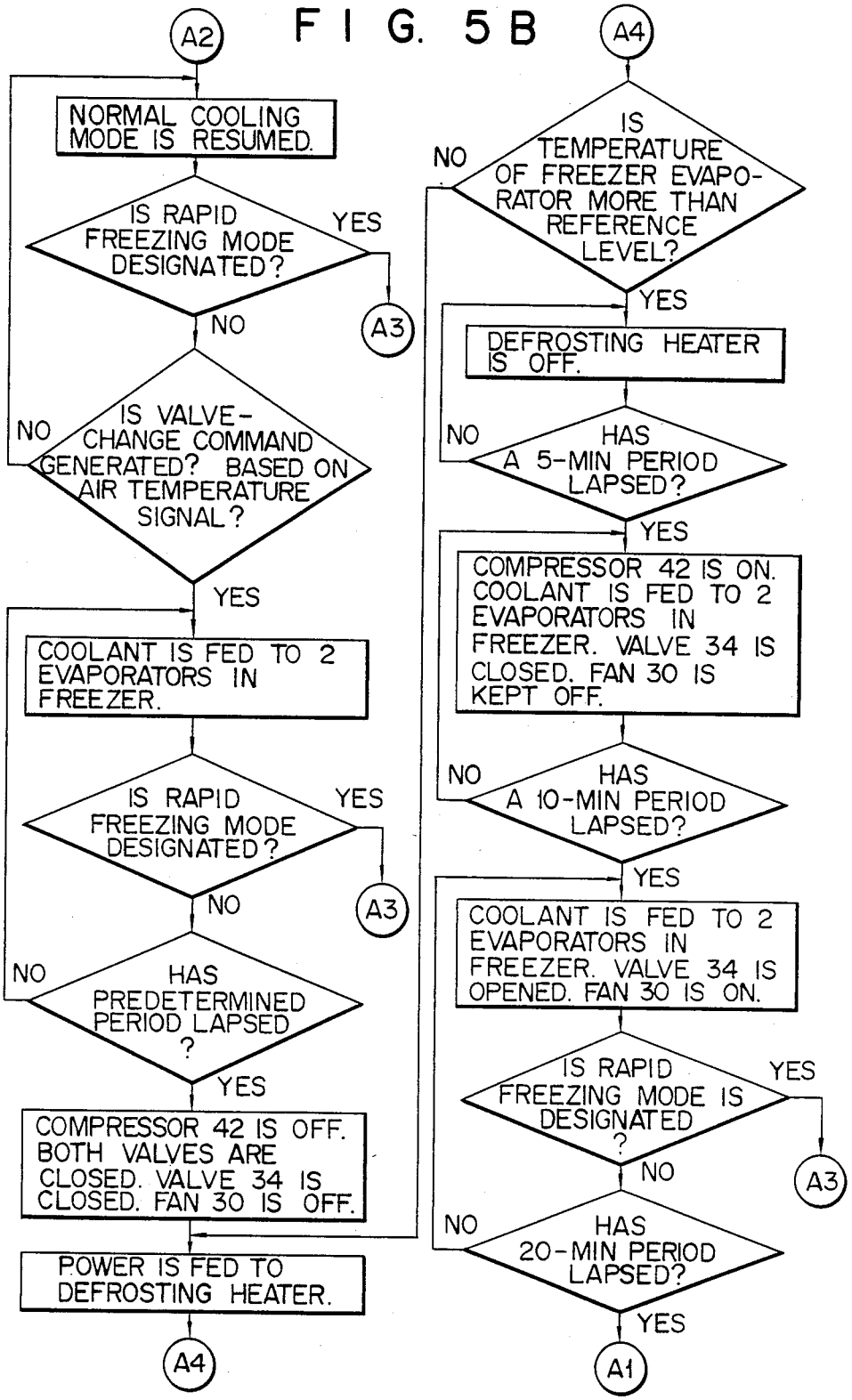
FIG. 5B is a flow chart indicating the main steps of the defrosing operation of said refrigerator.

Referring to FIG. 3, an electric circuit for controlling the coolant circulation circuit of FIG. 2 is shown. A control unit containing a microprocessor (not shown) is connected to a temperature detector unit 62, operation-display unit 64, and drive unit 66. As shown in FIGS. 4A, 4B, the temperature detector unit 62 includes a plurality of temperature sensors: (1) a first temperature sensor 68 which is directly attached to the refrigeration-chamber evaporator 20 so as to detect the current temperature of the evaporator 20; (2) a second temperature sensor 70 which is provided in the refrigeration chamber 16 to detect the current gas temperature therein; (3) a third temperature sensor 72 set on the first freezing evaporator 22 to detect the temperature of the evaporator 22; and (4) a fourth temperature sensor 74 fixed on the surface of the vertical plate of the duct-constituting metal plate 26 to detect the current air temperature in the freezing chamber 14.

The control unit 60 supplies a command signal 74 to a drive unit 66 according to temperature data furnished by the temperature detector 62. The drive unit 66 is connected to the electromagnetic valves 48, 50 through the PNP type switching transistors 76, 78. Therefore, the drive unit 66 actuates the electromagnetic valves 48, 50 under the control of the control unit 60 so as to ensure their stable operation. Two heaters 80, 82 are connected to an AC power source 84 through the corresponding relay switches 86, 88. One heater 80 is attached to the first freezing evaporator 22, provided in the air duct 28 of the freezing chamber 14 in FIG. 1, in order to thermally melt the frost deposited over the surface of the evaporator 22 during the defrosting mode of the refrigerator. The other heater 82 is used as a damper heater for forcefully heating, if necessary, the heat-sensitive section 38 of the damper unit 36 designed to drive the plate valve 34, which is operated to control the flow of a cold air through the duct 28 of FIG. 1. The fan motor 32 of FIG. 1 is connected to the AC power source 84 through a relay switch 90. A motor 92 for driving the compressor 42 is connected to the AC power source 84 through a relay switch 94. These mechanical switches 86, 88, 90, 94 are intermittently operated by the drive unit 66 under the control of the control unit 60. It should be mentioned that, in FIG. 3, a reference numeral 96 denotes a known lamp for illuminating the inner space of the refrigeration chamber 16. The lamp 96 is lit when a door switch 98 is rendered conductive in response to the opening of the refrigeration-chamber door 18*b*. The display unit 64 includes LED lamp (not shown) for indicating the various operation modes of the subject refrigerator, for instance, the normal cooling mode, high-speed freezing mode, defrosting mode, etc., and switches (not shown) normally actuated by an operator to regulate the temperature of the subject refrigerator and effect the changeover of the various operation modes.

FIGS. 4A and 4B indicate in greater detail a circuit arrangement related to the control unit 60. The first temperature sensor 68 for detecting the temperature on the wall of the refrigeration-chamber evaporator 20 is connected through a resistor R1 to a noninverting input terminal of a first comparator consisting of an operational amplifier 100. A first reference voltage Va is applied by resistors R2, R3 to an inverting input of the comparator 100. The comparator compares an input temperature signal delivered from the first temperature sensor 68 with the reference voltage Va and generates a first comparision signal S1. The second temperature sensor 70 for detecting the current gas temperature in the refrigeration chamber 16 is connected to an inverting input terminal of a second comparator 104 through a resistor R4. A second reference voltage V6 is changeably supplied through the registors R5, R6, R7 and a variable resistor VR1 to a noninverting input terminal of the second comparator 104. This second comparator 104 compares a temperature signal supplied from the temperature sensor 70 with the reference voltage Vb and generates a comparison signal S2. The third temperature sensor 72 for detecting the current temperature of the first freezing evaporator 22 is connected to an inverting input terminal of a third comparator 106 through a resistor R8. A third reference voltage Vc is supplied by resistors R9, R10 to a noninverting input terminal of the third comparator 106. This comparator 106 compares a temperature signal from the sensor 72 with the reference voltage Vc and generates a resultant comparison signal S3. An inverting input terminal of a fourth comparator 108 is connected to the fourth temperature sensor 74 through a resistor R11. A noninverting input terminal of the fourth comparator 108 is connected to a variable resistor VR2. One terminal of the variable resistor VR2 is connected to a DC voltage terminal +V through a resistor R12, while the other terminal thereof is grounded through a resistor R13. A resistor R14 is connected in parallel to the variable resistor VR2. An output signal from the fourth comparator 108 is fed back to the resistor R14 through a diode 110 and two resistors R15, R16. The fourth comparator 108 receives a temperature-detection signal from the fourth temperature sensor 74 and compares it with a fourth reference voltage Vd changeably produced by the variable resistor VR2 to generate a fourth comparison signal S4.

It should be noted that this comparator 108 has a hysteresis loop 112 containing the diode 110, whereby a difference takes place in the level of the fourth comparison signal S4 between the period during which the air temperature in the freezing chamber is rising and the period during which the air temperature is falling, and consequently, a prescribed difference is made to rise between the temperature at which the compressor 42 should be stopped and the temperature at which said compressor 42 should be reactivated.

Referring now to FIG. 4A, the control unit 60 includes a mode priority-judging circuit (priority determinator) 116 connected to a mode-designating switch 117, which is provided in the operation/display unit 64. As later detailed, the refrigerator may carry out not only the normal refrigerating mode, but also a rapid freezing mode and defrosting mode. The above circuit 116 generates a mode-specifying signal 118 in accordance with the preference order allotted to the various operation modes. The mode-specifying signal 118 is supplied to an input signal-judging circuit (input signal identifier) 120. When it is formed that the mode-specifying signal 118 represents the commencement of the rapid freezing mode, the circuit 120 causes a timer to be operated at a preset time of, for example, 90 minutes.

Output signals S1, S2, S4 from the temperature-detecting circuit 62 (respectively representing the temperatures of the refrigerating chamber cooler, refrigerating chamber air, and freezing chamber air) are supplied to the corresponding temperature-judging circuits 124, 126, 128 (namely, temperature signal processors). The temperature-judging circuits 124, 126 are connected to a valve drive controller 130 which controls the operation of the aforesaid valves 48, 50. Valve drivers 132, 134 drive the valves 48, 50 in response to output signals from the valve drive controller 130. The temperature-judging circuit 124 is further connected to a timer 136 which consists of a first time component **136*a* for the protection of the refrigerating chamber and a second timer component 136*b* for the defrosting of the refrigerating chamber. With the embodiment of this invention, the first timer component 136*a* performs a timer action of, for example, 30 minutes, while the second timer component 136*b* carries out a timer action of, for example, 10 hours and sends a timer action-termination signal 138 to the valve drive controller 130. The temperature-judging circuit 128, actuated in response to the freezing-chamber air-temperature signal S4, is connected to a compressor driver 142 and fan driver 144, both provided in the driver circuit 66, through a logic gate 140 which performs an OR logic function. Input terminals of the logic gate 140 are supplied with output signals from the input signal-judging circuit 120, and the timers 122, 136*a*. The valve drive controller 130 is supplied with output signals from the rapid freezing timer 122 and compressor driver 142**.

A signal S3 representing the temperature of the freezing chamber cooler and an ON signal from the temperature-judging circuit 126 are supplied to a defrosting control circuit 150 provided in the control unit 60. The defrosting control circuit 150 includes a freezer-precooling circuit 152 which generates a set signal in response to the ON signal from the temperature-judging circuit 126. The freezer-precooling circuit 152 is connected to the drivers 134, 142, 144 through a logic gate 154, and also to a defrosting timer circuit 156 which consists of freezer-defrosting timer units **156*a*, 156*b* which carry out different defrosting timer action, for example, of 15 and 10 minutes. The timer unit 156*a* is connected to the logic circuit 154 and damper-preheating circuit 158. This damper-preheating circuit 158 supplies a set signal to the other timer unit 156*b* and logic gate 160. An output reset signal from the timer unit 156*b* is conducted not only to the reset input terminal of a logic gate 160, but also to a defrosting heater circuit 162. This circuit 162 is connected to a logic circuit 164 whose reset input terminal is supplied with the signal S3. The logic circuits 160, 164 are respectively connected to a damper heater driver 166 for operating the damper heater 82 and a defrosting heater driver 168 for actuating the defrosting heater 80. A reference numeral 170 represents an integrator which sums up the total operation fime of the compressor 42, and when the integrated operation time reaches a prescribed amount, example, 48 hours, issues a command signal 172** instructing the commencement of the defrosting mode.

The defrosting control circuit 150 includes a delay circuit 174 which receives a temperature signal S4 and is connected to the drive unit 66 through a logic gate 176. A timer 178 consisting of a ten-minute timer component **178*a* and twenty-minute timer component 178*b* is connected to the circuits 174, 176 and also to a freezer protection circuit 180. This freezer protection circuit 180 sets a logic gate 182 connected to the drive unit 66. The logic gate 182 is connected to the timer 178 so as to be reset by the aforesaid twenty-minute timer component 178*b***.

A description may now be made of the operation of an electric refrigerator embodying this invention.

Ordinary Operation

In the ordinary operation mode, the drive unit 66 causes, under the control of the control circuit 60, (1) the motors 32, 92 to be driven, (2) the electromagnetic valve 48 to open, and (3) the valve 50 to close, whereby the coolant delivered from the compressor 42 is supplied to both the cooling evaporator 20 in the refrigerating chamber 16 and the first freezing evaporator 22 in the freezing chamber 14. Therefore foodstuff placed in the refrigerating chamber 16 and freezing chamber 14 can be cooled. A coolant drawn off from the compressor under such condition is liquefied by condensor 44 in the flow path shown in FIG. 2. The liquefied coolant is supplied to two evaporators 20, 22 through the valve 48 to cool the refrigerating chamber 16 and freezing chamber 14. During this period, the temperature sensors 68, 70, 72, 74 involved in the temperature detector 62 are operated to sense the temperature. During the ordinary mode, the interior of the refrigerating chamber 16 is cooled by natural convection. In the freezing chamber 14, the plate valve 34 is opened by the damper unit 36, and a coolant-ejected from the evaporator 22 is forcefully circulated through the duct 28 by the rotating fan 30 (as shown by arrows A1, A2, A3, A4 in FIG. 1). Therefore, the interior of the freezing chamber 14 is effectively cooled.

The fact that the air temperature in the refrigerating chamber 16 has fallen to a prescribed level T1 is detected by the temperature sensor 70. In response to the temperature signal S2, the control unit 60 commands the drive unit 66 to close one valve 48 and open the other valve 50. As a result, a coolant sent forth from the compressor 42 is prevented from entering the evaporator 20, but is allowed to run through the opened valve 50 only to the two freezing evaporators 24, 22 provided in the freezing evaporator 14. Such coolant passage switching mode will be explained in detail with reference to FIG. 4. In response to the temperature signal S2 generated from the comparator 104 involved in the temperature detection circuit 62, the temperature-judging circuit 126 supplies an operation signal to the valve drive controller 130. In response to the signal, the valve drive controller 130 so controls the valve drivers 132, 134 involved in the drive unit 66 as to cause one valve 48 to be closed and the other valve 50 to be opened. The above-mentioned changeover of the coolant passage ensures the operation of only the freezing cooler 22 and refrigerating cooler 24, thereby forcefully cooling the interior of the freezing chamber 14.

When, during the above-mentioned operation, the air temperature in the freezing chamber 14 falls to a prescribed level T2, the drive unit 66 renders both the compressor 42 and the fan motor 30 inoperative and closes the valves 48, 50 under the control of the control unit 60. Referring to FIG. 4, when receiving a signal S4 from the temperature detector 62 denoting the air temperature of the freezing chamber 14, the circuit 128 stops the operation of the compressor driver 142 and fan driver 144. During the stoppage of the compressor 42, both valves 48, 50 are closed, thereby preventing a hot coolant gas, which is stagnant in the compressor 42 immediately after the stoppage of the compressor 42, from being leaked into the cooler (the leakage of the coolant gas might otherwise prevent an efficient cooling of the cooler). Further, the closing operation of the both valves 48, 50 causes the coolant gas in the condenser 44 to be highly condensed to facilitate the subsequent activation of the compressor 42. When, during the stoppage of the coolant flow, the air temperature in the freezing chamber 14 rises above a prescribed level T3, the compressor 42 is again operated upon receiving a temperature signal S4 under the control of the control unit 60.

Description is now made of a second timer component **136*b* which commences a timer action at the start of the ordinary operation in which one valve 48 is opened, and a coolant delivered from the compressor 42 is supplied to the evaporator 20 of the refrigerating chamber 16 and the evaporator 22 of the freezing chamber 14. This timer component 136*b* carries out a timer action of, for example, 10 hours. At the end of such 10-hour period, the timer component 136*b* supplies a timer period termination signal 138 to the valve drive controller 130. Upon receipt of the signal 138, the controller 130 forcefully effects the aforementioned changeover of the valve operation by which the valve 48 is closed, and the other valve 50 is opened, regardless of whether or not the temperature-judging circuit 124 issues any instruction. Therefore, a coolant delivered from the compressor 42 is prevented from being continuously supplied to the two evaporations 20, 22 for more than ten hours. Thus, the frost deposited on the refrigerating chamber evaporator 20 is allowed to naturally melt. Therefore, it is possible to suppress the occurrence of the undesirable condition in which a large amount of frost might otherwise settle on the surface of the refrigerating chamber evaporator 20**, thereby reducing the cooling effect of the subject refrigerator.

The first timer component **136*a* provided in the control unit 60 carries out a timer action of 30 minutes in response to an output signal from the temperature-judging circuit 124, and generates a compressor-starting instruction to the compressor driver 142 through the logic gate 140. 30 minutes after the temperature of the refrigerating chamber 16 rises during the stoppange of the cooling operation, above the temperature level (for example, 3.5° C.) at which cooling should be applied, then the aforementioned ordinary cooling operation is commenced again. It will be noted that the resumption of the ordinary cooling operation is carried out quite independently of the control of the aforesaid reactivation of the compressor, which is carried out in response to the signal S4 denoting the air temperature of the refrigerating chamber 16. Since, therefore, the air temperature of the freezing chamber 14 is held below the prescribed temperature T3 during the stoppage of the cooling operation, though the temperature of the refrigerating chamber 16 stands at a higher level than 3.5° C., the cooling operation is not obstructed, thereby preventing the foodstuff stored in the refrigerating chamber 16** from being damaged.

Rapid freezing operation

When the operator manually activates the operation-display unit 64 to select a rapid freezing mode, in response to a mode-selecting signal 118 from the preferred mode-judging circuit 116, the timer 112 is rendered operative and the compressor driver 142 drives the compressor motor 92. Under the control of the valve drive controller 130, the driver 132 closes the valve 48 and the driver 134 opens the other valve 50. As a result, a coolant drawn from the compressor 42 is delivered only to the two freezing evaporators 22, 24. Therefore, the foodstuff stored in the freezing chamber 14 is rapidly frozen directly by the coolant issued from the evaporators 22, 24 and indirectly by the circulation of said coolant. When the rapid freezing operation has continued for 90 minutes by controlling the operation time of the timer 112, the subject refrigeration has its operation changed over to the ordinary refrigerating mode.

Defrosting operation

When the integrated time of the integration timer 170 involved in the defrosting control circuit 150 reaches a prescribed level (in the embodiment of this invention, 48 hours as previous described), a defrosting-commencing command signal 172 is generated to automatically start defrosting. During the defrosting mode, the frost deposited on the first freezing evaporator 22 acting as a main cooler is removed (this also includes the frost settled on the second freezing evaporator 24 which has been attached to the first freezing evaporator 24 by sublimation).

(A) cooling immediately before defrosting

In response to the previously described defrosting mode-commencing signal 172, the freezer pre-cool circuit 152 sets the logic gate 154, thereby causing the driver unit 66 to open one valve 48 and close the other valve 50. As a result, a coolant sent forth from the compressor 42 is supplied to the evaporators 20, 22, which respectively cool the freezing chamber 14 and refrigerating chamber 16. This cooling operation is continued until the temperature-judging circuit 126 has determined, upon receipt of a signal S2 denoting the gas temperature of the refrigerating chamber 16, that the gas temperature of the refrigerating chamber 16 has fallen to a lower level than the prescribed temperature T1. At this time the pre-cool circuit 152 sets the fifteen-minute timer **156*b*, causing the valve drivers 132, 134 to carry out the changeover of the coolant passage. As a result, one valve 48 is closed and the other valve 50 is opened. Consequently, the interior of the freezing chamber 14 alone is cooled by the directly cooling type evaporator 24. Fifteen minutes after the above-mentioned pre-cool operation has started, the time 56***a* resets the logic gate 154.

(B) main defrosting operation

When the logic gate 154 has been reset, the driver unit 66 stops the compressor 42, and closes both valves 48, 50 and stops the fan motor 32. Consequently, the cooling of the subject refrigerator is temporarily stopped for defrosting. At this time, a reset signal sent forth from the fifteen-minute timer 156*a* is also supplied to the damper-preheating circuit 158, which in turn supplies a damper heat command signal 184 to the drive unit 66 through the logic gate 160. The driver 166 allows for the power supply to the damper heater 82, thereby causing the bellows 37 of the damper unit 36 to thermally swell. The thermal swelling of the bellows 37 closes the plate valve 34, thereby shutting off the air duct 28 formed in the freezing chamber 14. At this time, the damper-preheating circuit 158 sets the ten-minute timer 156*b*. Therefore, the control of the ten-minute period is undertaken by said timer 156*b*.

Ten minutes after the thermal swelling of the bellows 37 of the damper 36, the ten-minute timer 156*b* sets the defrosting heater circuit 162. This defrosting heater circuit 162 supplies an instruction 186 for the commencement of the defrosting heat to the drive unit 66 through the logic gate 164. Consequently, the driver 168 involved in the drive unit 66 activates the defrosting heater 80, thereby heating the gas held in the air duct 28 surrounding the first freezing evaporator 22 acting as a main cooler. The heated air melts the frost deposited on the surface of said evaporator 22.

When the heating of the first freezing evaporator 22 is continued even after the termination of its defrosting, the temperature on the surface of the evaporator 22 rapidly rises. This rapid rise of the surface temperature of the evaporator 22 is detected by the temperature sensor 72. The signal S3 denoting the temperature of the freezing-chamber evaporator 22, which is generated from the temperature detector 62 in response to an output signal from the temperature sensor 72, delivered to the logic gate 164 to set it. As a result, the power supply to the defrosting heater 80 is stopped, thereby terminating defrosting heating.

The closure of the air duct 28 by the valve 34 during the defrosting made prevents water steam, produced by temperature rise in the air duct 28, from being frozen in contact with the surface of the directly cooled evaporator 24 when entering the freezing chamber 14 by the convention resulting from a difference between the temperature of the duct 28 and that of the freezing chamber 14 (held at a relatively low temperature). The valve 34 remains closed while the air on the duct 28 which lies near the evaporator 22 is heated by the defrosting heater 80. Consequently, the heated air in the duct 28 is prevented from being carried into the freezing chamber 14.

(C) Operation attendant upon the termination of defrosting

In response to the aforementioned signal S3, the delay circuit 174 carries out a delaying operation for a prescribed length of time, for example, five minutes. As a result, the logic gate 176 is set five minutes after the power supply to the defrosting heater 80 is stopped. Therefore, until the lapse of five minutes after the shut off of the power supply to the defrosting heater 80, the subject refrigerator 10 remains in the condition in which the valve 34 closes the air duct 28, and the compressor 42 is rendered inoperative. During this period, water drops attached to the surface of the main freezing-chamber cooler 22 due to the melting of frost fall gravitationally, thereby preventing the water drops from being frozen by the commencement of the cooling operation. After the completion of the water drop removal, which is controlled by the timer, the resumption of the prescribed cooling of the subject refrigeration is effected by the undermentioned steps.

Upon the lapse of five minutes, the delay circuit 174 sets the logic gate 176 and ten-minute timer 178*a*. Therefore, the drive unit 66 drives the compressor 42 and opens the valve 50, thereby supplying a coolant sent forth from the compressor 42 to the freezing evaporators 22, 24 and absorbing the heat generated during the defrosting mode. During the heat-absorbing operation, the freezer air duct 28 remains closed by the valve 34 and the fan 30 remains inoperative. Thus, it is possible to substantially eliminate the drawback that, when cooling is resumed upon completion of defrosting, the damper 36 is opened and the fan motor 32 is driven. Steam or heat remaining in the main cooler 22 and air duct 28, resulting from the defrosting operation, tends to be carried into the freezing chamber 14.

Ten minutes after the termination of defrosting, the logic gate 176 is reset. Instead, the twenty-minute timer 178*b* and logic gate 182 are set by a circuit 180. As a result, the drive unit 66 actuates the compressor 42, the power supply to the damper heater 82 ceases, and the valve 34 is opened. The fan motor 32 is driven to rotate the fan 30. The valve 48 is closed, while the valve 50 is opened. Consequently, the freezing operation of supplying a coolant from the compressor 42 to the freezing evaporators 22, 24 is continued for twenty minutes under the control of the twenty-minute timer 178*b*. The above-mentioned forced freezing oeration helps the restoration of the prescribed gas temperature in the freezing chamber 14. After twenty minutes, the subject refrigerator is restored to the ordinary operation mode.

(D) Preferential order of the rapid freezing and defrosting operations

In the practical application of the electric refrigerator, it sometimes happens that during the defrosting cycle (including the stops preceding and following the defrosting cycle) a rapid freezing-starting command is generated. A description may now be made of the manner in which the preferential order of the freezing and defrosting operations is determined in the above-mentioned case.

If a rapid freezing-starting command is received under the condition in which a defrosting instruction has already been issued and yet forced cooling of preceding the defrosting is still continued, or after the termination of the absorption of retained heat resulting from defrosting, then the control unit 60 commands the preferential performance of rapid cooling, stops the subsequent defrosting step, and renders the subject refrigerator ready for the reissue of a defrosting command signal.

If a rapid freezing-starting command is received during a period extending from the point of time at which forced cooling, preceding defrosting, is brought to an end to the point of time at which the absorption of heat retained after defrosting ceases, then the defrosting step is preferentially taken.

In the above-mentioned embodiment, the temperature of the refrigerating chamber was determined by detecting the air temperature and the temperature of the refrigerating chamber cooler itself. Signals denoting the detected temperatures were selectively used in accordance with an intended object of control. However, it is possible to regard either of said temperature signals as that which represents the temperature of the refrigerating chamber.

The freezing chamber 14 of an electric refrigerator embodying this invention is provided with a main evaporator 22 designed for circulation type freezing and a shelf-shaped auxiliary evaporator 24 designed for direct type freezing. Therefore, it is possible to eliminate irregular freezing which might be caused by the different slots of the freezing chamber in which the object of freezing is placed. Further, the object of freezing placed on the shelf-shaped auxiliary evaporator 24 horizontally held substantially in the center of the freezing chamber 14 can be rapidly frozen.

With the electric refrigerator of this invention, the freezing chamber 14 and refrigerating chamber 16 are cooled, before the frost deposited on the main evaporator 22 is removed by the heater 80, thereby preventing the foodstuff stored in the refrigerator from being subjected to a harmful effect which might otherwise result from the defrosting operation. When the defrosting mode approaches the termination, the freezing chamber 14, undergoing a harmful effect exerted by the defrosting heater 80, is preferentially cooled to ensure the early restoration of the prescribed temperature of the freezing chamber 14.

It will be noted, particularly in the defrosting mode, that the valve 34 provided in the air duct 28 in which the main evaporator 22 is held is closed by the damper 36. The application of this damper 36 offers the advantages that during the defrosting mode, the resultant steam or unnecessary heat is prevented from entering the freezing chamber 14, and it is possible to prevent both the occurrence of freezing on the surface of the auxiliary evaporator 24 and the abnormal rise of the temperature of the freezing chamber 14. Before the freezing chamber 14 is cooled in the last step of defrosting, the damper 36 is closed and the fan 30 is stopped. Since a coolant is supplied to the main evaporator 22 under the above-mentioned condition, heat remaining in the gas passage can be absorbed, thereby preventing the heat from being carried into, for example, the auxiliary evaporator 24. After the stoppage of the power supply, the defrosting heater is allowed to stand in fact for some time, and then a coolant is conducted to the main evaporator 22. During the period in which no power is supplied to the defrosting heater, water drops attached to the surface of the main evaporator 22 due to the melting frost gravitate downward, thereby preventing the water drops from being frozen on the surface of the main evaporator 22 when the cooling operation of the subject refrigerator is commenced.

What is claimed is:

1. An electric refrigerator comprising:

housing means for forming first and second thermally insulative spaces, said insulative spaces being: (a) a freezing chamber including a duct for air circulation, said duct allowing air to be drawn off from the freezing chamber and flow back thereto, and (b) a refrigerating chamber;

first freezing cooler means, located in said duct of said freezing chamber, for generating cold and thereby cooling air and for cooling said air in said duct, by convection;

second freezing cooler means, provided in said freezing chamber, for applying cold directly to said object to freeze said object by radiation cooling;

fan means, located in said freezing chamber, for forcing circulation of air past said first freezing cooler means to said freezing chamber through said air duct;

valve means, provided in said air duct, for mechanically closing said duct to prevent air flow through said duct; and defrosting means, electrically coupled to said first and second freezing cooler means and to said fan and valve maans, for, during defrosting mode operation: (1) rendering said fan and said first means inoperative while said valve means is closed, (2) heating said first freezing cooler means in such a manner as to melt frost deposited thereon, and (3) forcibly preventing said fan from being operative and said valve means from being open, for a predetermined time period after said defrosting mode is completed, said first freezing cooler means being rendered operative again after said predetermined time period.

2. The refrigerator according to claim 1, wherein said valve means comprises:

a plate-shaped valve which is located in the air duct so as to selectively open and close the air duct; and damper means, mechanically coupled to said valve means, for thermally expanding in accordance with receipt of external heat to press said valve, and thereby closing said valve.

3. The refrigerator according to claim 2, wherein said defrosting means comprises:

damper heater means coupled to said damper means, for heating said damper means during said defrosting mode.

4. The refrigerator according to claim 3, wherein said defrosting means further comprises:

defrosting heater means, provided in said air duct in proximity to said first freezing cooler means, for indirectly heating said first freezing cooler means thereby removing frost deposited thereon; and heater driver means for detecting the temperature of said first freezing cooler means and for rendering said defrosting heater means inoperative when the detected temperature of said first freezing cooler means reaches a predetermined level.

5. The refrigerator according to claim 4, wherein said defrosting means further comprises:

fan driver means connected to said fan means, for shutting off said fan means during said defrosting mode.

6. The refrigerator according to claim 5, wherein said second freezing cooler means comprises:

a shelf-shaped evaporator means set in said freezing chamber in a load bearing manner, for allowing objects to be positioned on said shelf-shaped evaporator means, and for directly freezing said objects positioned thereon by radiation cooling.

7. The refrigerator according to claim 6, wherein said air duct has a groove in which said damper means is placed.

8. The refrigerator according to claim 7, further comprising:

cooling means provided in said refrigerating chamber, for cooling the interior of said refrigerating chamber;

compressor means, coupled to said first and second freezing cooler means and said cooling means, for selectively circulating a coolant through said first and second cooler means when energized; and means for selectively altering passage of said coolant between (a) a first condition in which a coolant drawn off from said compressor means is supplied to said cooling means and said first freezing cooler means, (b) a second condition in which said drawn off coolant is supplied to said first and second freezing cooler means, and (c) a third condition in which said drawn off coolant is not supplied said cooling means and is supplied to said first and second freezing cooler means.

9. The refrigerator according to claim 8, further comprising:

integration timer means, connected to said compressor means and to said defrosting means, for integrating the operation period of said compressor means and for, causing said defrosting means to start its defrosting operation when the integrated operation period reaches a predetermined length of time.

10. An apparatus as in claim 1 wherein said first freezing cooler means is a main freezing cooler, and said second freezing cooler means is an auxiliary freezing cooler.

11. The electric refrigerator according to claim 2, wherein said defrosting means comprises:

a damper heater coupled with said damper means; and damper heater driver means connected to said damper heater, for driving said damper heater in such a manner as to cause said damper heater to continuously heat said damper means for said predetermined time interval after the defrosting mode is completed, thereby keeping said plate-shaped valve closed in said air duct of the freezing chamber.

12. The electric refrigerator according to claim 11, wherein said defrosting means further comprises: fan driver means connected to said fan, for shutting off said fan during said defrosting mode, and for keeping said fan shut off for said predetermined time interval after said defrosting mode is completed.

13. The electric refrigerator according to claim 12, wherein said defrosting means further comprises: timer controller means connected to said damper heater driver means and said fan driver means, for measuring the elapsing of said predetermined time interval and for controlling said damper heater driver means and said fan driver means so as to turn on said damper heater and said fan upon the lapse of said predetermined time interval.

14. A device as in claim 1 further comprising display unit means for displaying a mode of operation corresponding to the operating state of said refrigerator.

15. A method for defrosting a main freezing cooler provided in an air duct within a freezing chamber of an electronic refrigerator, said refrigerator generating cold air which is circulated by a fan to said freezing chamber through said air duct, a valve unit including a damper being provided in said air duct for selectively closing and opening said air duct, so as to freeze an object stored in said freezing chamber, said electronic refrigerator also having an auxiliary freezing cooler, also provided in the freezing chamber, to directly freeze said object using radiation cooling manner, said method comprising the steps of:

pre-cooling said freezing chamber by supplying coolant to said main freezing cooler and to said auxiliary freezing cooler;

shutting off said coolant to said main cooler and rendering said fan and said valve units inoperative, whereby air circulation through said air duct is prevented;

energizing a defrosting heater, which is located in said air duct in such a manner as to melt frost deposited on said main freezing cooler;

de-energizing said defrosting heater when the defrosting mode is completed and supplying coolant to said main freezing cooler, and preventing said fan from being operative and said valve unit from being open for a predetermined time period after said defrosting made is complete, whereby said air circulation in the freezing chamber through said air duct is continuously prevented for said predetermined time period; and causing said fan to be operative and said valve unit to be open after said predetermined time period has passed, thereby performing an pre-cooling operation upon said air duct.

16. The method according to claim 15, wherein, even after said defrosting mode is completed, said damper of said valve unit is continuously heated by a damper heater for said predetermined time period and thus thermally expands to continually press a plate-shaped valve, thereby closing it.

* * * * *